US005857570A

United States Patent [19]

Brown

[11] Patent Number: 5,857,570

[45] Date of Patent: Jan. 12, 1999

[54] PRIMARY AND SECONDARY PACKAGING SYSTEM FOR BEVERAGE PRODUCTS

[75] Inventor: Scott B. Brown, Ilderton, Canada

[73] Assignee: Labatt Brewing Company Limited, London, Canada

[21] Appl. No.: 912,837

[22] Filed: Aug. 18, 1997

[51] Int. Cl.[6] ..... B65D 65/78; B65D 5/46

[52] U.S. Cl. ..... 206/427; 206/576; 229/117.13; 229/170.09; 229/120.11

[58] Field of Search ..... 206/427–431, 206/434, 433, 526, 193, 198; 229/120.09, 120.011, 240, 235, 117.13

[56] References Cited

U.S. PATENT DOCUMENTS

| | | | |
|---|---|---|---|
| 2,660,300 | 11/1953 | Pauls | 206/526 X |
| 2,791,362 | 5/1957 | Nute et al. . | |
| 2,830,726 | 4/1958 | Foster et al. . | |
| 2,883,046 | 4/1959 | Weiner | 206/433 |
| 2,983,372 | 5/1961 | Amatel et al. . | |
| 3,002,613 | 10/1961 | Merkel et al. | 206/193 |
| 3,018,919 | 1/1962 | Pelt et al. . | |
| 3,094,268 | 6/1963 | Swanson et al. | 229/117.13 |
| 3,099,380 | 7/1963 | Nathan | 229/117.13 X |
| 3,166,232 | 1/1965 | Tichenov | 229/120.09 X |
| 3,215,332 | 11/1965 | Bess | 229/120.09 X |
| 3,263,900 | 8/1966 | Link et al. | 229/120.09 X |
| 3,346,167 | 10/1967 | Schmidt | 206/427 X |
| 3,554,402 | 1/1971 | Lock . | |
| 3,677,458 | 7/1972 | Gosling . | |
| 4,256,223 | 3/1981 | Pawlowski . | |
| 4,331,289 | 5/1982 | Killy | 206/427 X |
| 4,340,170 | 7/1982 | Montealegre . | |
| 4,471,870 | 9/1984 | Uhlig . | |
| 4,487,318 | 12/1984 | Roen . | |
| 4,793,494 | 12/1988 | Gordon . | |
| 5,249,738 | 10/1993 | Werth . | |
| 5,299,733 | 4/1994 | Werth . | |

FOREIGN PATENT DOCUMENTS

| | | | |
|---|---|---|---|
| 988477 | 5/1976 | Canada . | |
| 1006852 | 3/1977 | Canada . | |
| 1182792 | 2/1985 | Canada . | |
| 1098789 | 1/1968 | United Kingdom | 229/120.09 |
| 1117295 | 6/1968 | United Kingdom | 229/120.011 |

*Primary Examiner*—Bryon P. Gehman
*Attorney, Agent, or Firm*—Cammarata & Grandinetti

[57] ABSTRACT

A container suitable for shipping and dispensing a plurality of individual products is disclosed. The container conforms with accepted beverage industry handling and distribution practices, is conveniently transported from the point of retail sale by the consumer, and facilitates the consumer's dispensing of individual products from the container. The container includes a carton that is adapted with a zone of weakness to break partially away along predetermined lines of weakness. This structure forms a pair of interhinged trays having a common handle between them. The contents of each tray are then disposed in a position that facilitates placing the carton in the consumer's refrigerator without the need for adjusting the spacing of shelves.

15 Claims, 4 Drawing Sheets

PRIMARY AND SECONDARY PACKAGING SYSTEM FOR BEVERAGE PRODUCTS

BACKGROUND OF THE INVENTION

1. Field of the Invention

The present invention relates to a packaging system suitable for shipping and dispensing a plurality of individual products. Specifically, this invention relates to a primary and secondary packaging system designed for the commercial handling, distribution, and domestic dispensing of beverage products.

2. Description of Related Art

The beverage industry, particularly the brewing industry, is faced with a number of limitations that impact the shipping, distribution, and handling of its products. These constraints affect both the commercial and consumer levels of product handling and storage.

The comestible products industry generally utilizes two types of packaging known as "primary" and "secondary" packaging. Primary packaging is used for individual products, whereas secondary packaging holds the primary packages for commercial handling and distribution.

The comestible products industry takes into account numerous considerations when designing packaging, such as quality, structural integrity, optimum size, and the like. For example, an optimum size for individual servings may be governed by law. The geometric shape of the primary packaging is designed to enclose a required volume while taking into consideration the convenience of storing and dispensing the primary packaged goods at the consumer level. Structural considerations arise in connection with the container's ability to withstand compressive forces that may be occasioned when a plurality of secondary packages are stacked during commercial handling. Further, the design must give due regard to the orientation of the primary packaging during commercial handling and the amount of air space in the primary packaging. In the beverage industry, specifically the brewing industry, where primary packages are typically cylindrical, it is desirable that a minimum amount of beverage surface be exposed to the air space when the can or the like is stored, shipped, etc. The exposure to air space can be minimized when the container is maintained in an upright position. Thus, quality preservation may dictate that the primary packaging be arranged in the secondary packaging in an upright orientation.

When dispensing primary packaged products from the secondary packaging at the consumer level, the upright orientation of the primary package is not always desirable. An upright container may not present sufficient surface area to be firmly grasped. In addition, storage space in a household refrigerator is not always ideally suited to having a can or bottle in an upright posture. It can be undesirable for the consumer to have to rearrange the refrigerator shelving to accommodate the presence of the product in its secondary packaging. In many cases, the primary packaging is simply removed from the secondary packaging. The secondary packaging is then discarded or stored elsewhere for later use, such as a container for returning empty primary packaging for recycling. These practices are inconvenient for the consumer, and there is interest in finding alternate methods of dispensing primary packaged products from associated secondary packaging. A number of attempts to solve this problem appear in the patent literature.

Canadian Patent Number 988,477 relates to a secondary packaging carton that utilizes a tear-away flap to open the carton. The flap can be torn away to expose the contents of the carton, which are cans oriented in an upright posture. A significant amount of vertical storage space is required if this arrangement is to be successfully used in a domestic refrigerator.

Other solutions have been advanced in the attempt to overcome the shortcomings that are attributable to the above-mentioned tear-away flap system. Examples include the packaging disclosed in Canadian Patent Numbers 1,006,852 and 1,182,792. In both of these patents, secondary packaging or cartons hold the primary packaging or "cans" serially. The cans are removable from a chute formed in a base portion of the associated carton. These cartons do not permit the consumer to see readily the number of cans remaining inside the carton. Moreover, while this design can handle a relatively small number of cans with relative ease, large numbers of cans present difficulties associated with vertical storage space.

U.S. Pat. No. 2,791,362 discloses a container for a plurality of fragile articles. The container has a one-piece partition member. The container and the partition member are adapted to divide easily in half along pre-scored lines. This construction prevents the partition member from being pulled from the half container when used as a carrying handle.

U.S. Pat. No. 2,983,362 discloses a container adapted to enclose a desired number of articles. The container is broken or split longitudinally to expose the ends of the articles in the container. The articles are rendered accessible for convenient removal from the container and easily reinserted for storage or subsequent disposal.

U.S. Pat. No. 3,018,919 discloses a can carrier designed to hold a plurality of cans evenly divided in two sets or rows. The carrier is constructed so as to be readily separable into two holders with each holder containing half of the cans. The device also has a handle that is also separable into two parts. This structure provides each of the two halves of the carrier, when separated, with its own handle.

U.S. Pat. No. 3,677,458 discloses an end-loading, twin carton that is separable into two cartons. The twin carton has folded handles usable with the twin carton and also with the separated cartons. A blank for the carton is also disclosed.

U.S. Pat. No. 4,256,223 discloses a display carton having two compartments that are movable between a carrying and a display configuration. A display panel with a display window opening therein is provided on each of the compartments. The display panels are exposed for viewing when the carton is in its display configuration but not when it is in its carrying configuration.

U.S. Pat. No. 4,471,870 discloses a package comprising a rigid tray member having an upstanding peripherally located rim portion. A plurality of discrete container assemblies are within the rigid tray member. Each container assembly has a plurality of individual containers in a regular geometric array interconnected by a unitary thermoplastic carrier means. A cover shroud overlays the tray and is secured to the tray rim to complete the package.

U.S. Pat. Nos. 5,249,738 and 5,299,733 both disclose a package formed from a one-piece wrapper. The one-piece wrapper is typically made of carrier board. The carrier board is folded around twenty-four cans or bottles including a top and bottom of the package. The package has cuts or perforations that partially separate the package into two twelve-packs. Each side of the package has at least one tear-strip aligned with the cuts or perforations that complete the separation to form two twelve-packs. The top of the package has a second pair of tear-strips that allows the two twelve-packs to be separated into four six-packs. The wrapper can be folded in such a manner that the two six-packs of each of the two twelve-packs are separated by an individual divider in the wrapper. This divider has a perforated top end that is aligned with the tear-strips. The two sides of the divider are held together by an adhesive. The adhesive allows the six-packs to be separated. The combination of the tear-strips and the adhesive holds the container together in a package of twenty-four cans or bottles that can be divided into two twelve-packs or four six-packs.

There remains a need in the beverage packaging industry for a primary and secondary packaging system that facilitates shipping in a secondary package and dispensing of a plurality of primary packages contained therein for the consumer.

SUMMARY OF THE INVENTION

The invention relates to a primary and secondary packaging system suitable for shipping and dispensing a plurality of individual products. The invention includes a plurality of primary, axially elongated, uniform, generally cylindrical beverage containers arranged in a planar side by side relation in a secondary packaging carton that is adapted for distribution and dispensation of the beverage containers. The carton has first, second, third, and fourth serially interconnected, rectangular walls. Serial pairs of the walls are cojoined along respective mutually adjacent edges thereof to circumscribe a generally rectangular volume and support a mutually opposed pair of panels in spaced relation from one another, thereby substantially enclosing the volume that is occupied by the beverage containers. Each one of the beverage containers is oriented with the axial elongation thereof extending in a direction generally normal to the respective parallel planes defined by said panels. A predetermined one of the panels has a medial hinge line extending longitudinally from a first to a second, opposite edge of the panel. A zone of weakness extends longitudinally from a point adjacent the intersection of the medial hinge line and the first edge, across the first wall, along the other of the panels and across the second wall to a point adjacent the intersection of the medial hinge line and the second edge. The carton is operable to tear selectively along the length of the zone of weakness, and thereafter to fold on application of a lateral, rotational bending moment about the longitudinally-extending hinge line to form a mutually adjacent and joined pair of dispensing trays circumscribed by respective portions of the first wall, the second wall, the predetermined one of the panels, and the other of the panels. The third and fourth walls individually form a base of each of the two trays.

The invention includes a unitary carton blank. The unitary carton blank has a first and second series of flaps arranged in opposed relation on either side of a longitudinally extending web. The flaps extend laterally and individually from each of a series of sections of the web defined by hinge lines. The first and second series of flaps are adapted to be cojoined to form respective first and second walls of a carton. Each section of the web corresponds to at least a portion of third and fourth carton walls and a first and a second panel. Longitudinally opposed ends of the web are adapted to be cojoined to produce a tubular form. The flaps are cojoined to form respective first and second end walls. A carton is formed having first, second, third, and fourth serially interconnected, rectangular walls with serial pairs of the walls being cojoined along respective mutually adjacent edges thereof to circumscribe a generally rectangular volume. The walls support the first and second panels in mutually opposed spaced relation on either side of the volume, thereby substantially enclosing the volume. A first section defines the first panel and includes a medial hinge line extending from a first to a second laterally spaced edge of the section. The corresponding flaps of the first and second series of flaps extend laterally from the first and second edges of the first section and include respective laterally extending zones of weakness aligned in longitudinal register with the medial hinge line. A second section defines the second panel having corresponding flaps of the first and second series of flaps extending laterally from first and second edges of the second section. A zone of weakness extends laterally across the flaps and the second section. The zones of weakness on the corresponding flaps of the first and second sections are adapted to be aligned in mutual register in the tubular form.

The invention also includes a method for dispensing a plurality of primary packages from the secondary packaging carton of the system described above. The method involves cutting, removing, or otherwise severing the zone of weakness on the secondary package. Folding the secondary package occurs in a rotating motion about its medial hinge line thereby dividing the secondary package into a plurality of mutually adjacent dispensing means.

DESCRIPTION OF THE PREFERRED EMBODIMENTS

Figure 1:
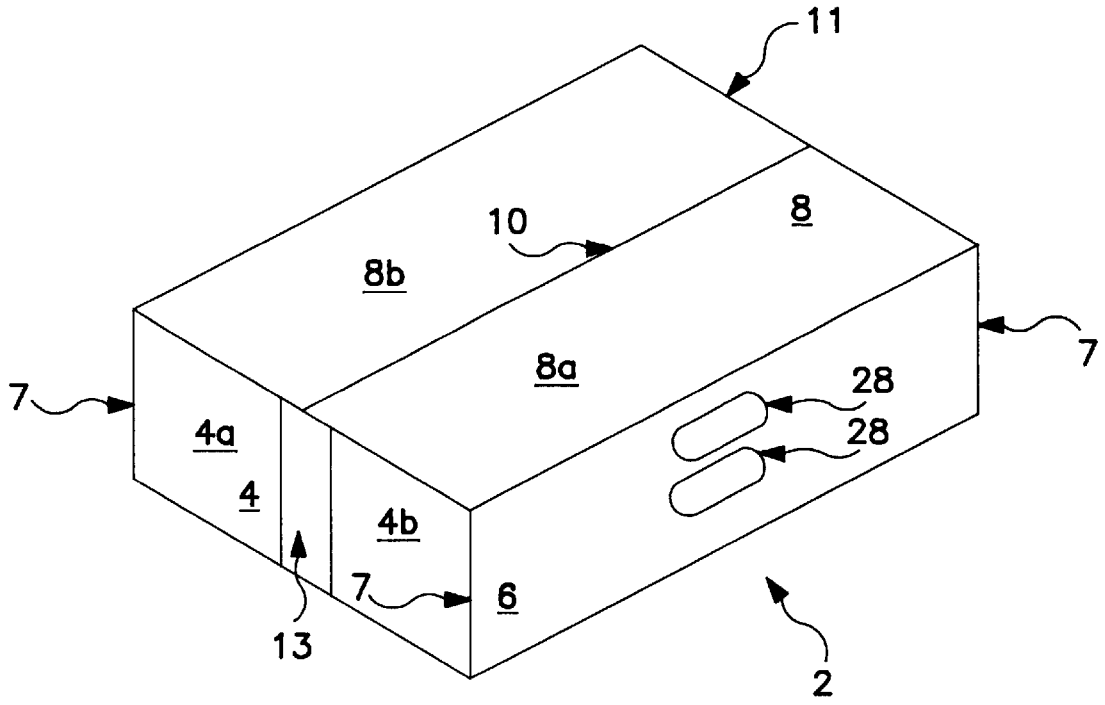
FIG. 1 illustrates an elevated perspective view of a carton with a medial hinge line shown on a first panel.

The invention is a primary and secondary packaging system suitable for shipping and dispensing a plurality of individual products. The secondary packaging comprises a carton having an opposed pair of panels in spaced relation. A first of the opposed panels has a medial hinge line that bifurcates the first panel. The carton has a zone of weakness, as described below. In a preferred embodiment, when the medial hinge line bends, the first panel is folded against itself, such that the container is opened to form a plurality of dispensing means suitable for dispensing beverage containers. The invention includes a method for converting the carton from the first condition to the second condition and a carton blank from which the carton can be manufactured.

The carton has four serially interconnected, rectangular walls. Serial pairs of the walls are cojoined along respective mutually adjacent, such as "shared," edges to circumscribe a generally rectangular volume. The walls support a mutually opposed pair of panels in spaced relation from one another and thereby substantially enclose the volume that is occupied by the primary packaging.

The secondary packaging can be a box, having two pairs of opposing, serially connected walls, and a pair of mutually opposed panels. The box is adapted to encase closely the space occupied by the primary packaging contained therein. The box can, for example, be made of cardboard, recycled paper products, a composite material, or other conventional material capable of providing adequate strength for shipping and dispensing the enclosed products.

The secondary package contains primary packaging adapted to enclose a variety of individual products of the comestibles industry, such as candy, carbonated beverages, milk, water, or other products for which ease of distribution is desirable. The primary packages for the individual products can be of a variety of shapes, such as a milk carton, can, bottle, bag, or other commercially available packaging means.

In a preferred embodiment, the secondary package is suitable for commercially shipping a plurality of axially elongated, uniform, generally cylindrical beverage containers, for example, cans or bottles, arranged within the secondary package. Each of the beverage containers is oriented with the axial elongation thereof extending in a direction generally normal to the pair of panels. The secondary package is adapted for distribution and dispensation of the beverage containers.

The secondary package comprises a carton or box having an opposed pair of panels in spaced relation. A first panel has a medial hinge line that extends from a first to a second opposite edge of the first panel. The medial hinge line bifurcates the first panel. The bifurcation can occur longitudinally or at an angle. The medial hinge line defines the location on the first panel where a bending moment can be applied to the carton or box to fold the first panel against itself to reveal a plurality of dispensing means. The dispensing means can be trays.

The carton can include a hand grip means. The hand grip means can be located on a third or fourth wall and can be a conventional hand grip that is integral to the container. In a preferred embodiment, the hand grip means can be employed to carry the carton as one would carry a suitcase when the zone of weakness is in the first condition.

The zone of weakness in the carton extends from a first end of the medial hinge line around the outer circumference of the carton to a second end of the medial hinge line. Specifically, the zone of weakness extends from a point adjacent the intersection of the first end of the medial hinge line and a first edge of the first panel. The zone of weakness then extends across a first wall, along a second panel, and across a second wall to a point adjacent to the intersection of the second end of the medial hinge line and a second edge of the first panel.

The zone of weakness has a first condition and a second condition. In the first condition, the zone of weakness binds the carton and prevents the medial hinge line from bending. The secondary package maintains the shape of a box when the zone of weakness is in the first condition. In the second condition, the zone of weakness is severed, torn, or broken. Once the second condition occurs, the medial hinge line is not bound by the zone of weakness, and the first panel can be bent over on itself to expose the plurality of dispensing means, for example, trays.

In a preferred embodiment, the first condition is maintained throughout shipping, so that a plurality of beverage containers or the "primary containers" can be restrained within the secondary package to prevent damage during transit.

The zone of weakness can comprise any of a variety of structures that can maintain the shape of the secondary package in the first condition and allow the top of the secondary package to be folded about the medial hinge line in the second condition. For example, the zone of weakness can be a single perforated line of weakness or two perforated lines of weakness that form a tear strip between them. The tear strip can be formed by two lines of weakness that are essentially parallel. Preferably, the distance between them is not substantially greater than the diameter of the cylindrical containers that can comprise the primary packaging. The two lines of weakness can have convergent and divergent sections. The convergent and divergent sections of the zone of weakness directly affect the shape of the top edge of the dispensing means. To improve dispensability, the shape of the zone of weakness can be adapted to make the products contained within the dispensing means more accessible.

Alternatively, the zone of weakness can include a strip of pliable material that is adhered to the zone of weakness to aid in tearing or severing it. The material can be utilized with either a single line of weakness or multiple lines of weakness.

Each of the dispensing means has two ends, an inner side, an outer side, and a base. The ends of each dispensing means are defined by respective portions of the first wall and the second wall. The inner sides of each dispensing means are defined by the first panel. The first panel is folded against itself. In a preferred embodiment, the height of the ends and the outer sides formed by the first wall, the second wall, and the second panel is reduced by half the width of the zone of weakness. Further, the shape of the ends and outer sides is dependent upon the shape of the zone of weakness. The bases of the dispensing means are defined by the third and the fourth walls of the carton.

The carton can comprise pleated means. The pleated means can be a single fold or a plurality of folds in the wall and/or panels of the carton. When the zone of weakness is in the first condition, the pleated means is adjoined to the secondary package such that the secondary package maintains a box shape. However, in the second condition, when the carton is folded to expose the dispensing means, the pleated means can be employed to expand the dispensing means. Once the dispensing means has been expanded by employing the pleated means, cooling means, such as ice, can be added to fill the additional space created by the expanded pleated means, to cool the beverage containers.

The container can also comprise lining means. The lining means can cover the interior of the container, the exterior of the container, or both. The lining means can be manufactured from a material that is impervious to liquids, such as a plastic, or can include a coating or a liner. If a liner is employed, the liner can be removable and hold the primary packages and cooling means independently of the secondary package.

The secondary package can also include handles or a handle means to facilitate the handling of the trays. The handle means can be arranged midway along the medial hinge line and extend internally of the enclosed volume. The handle means is adapted to present an elevated graspable structure between the dispensing means upon opening the carton. This feature of the invention facilitates the handling of the dispensing means, for example, trays, by providing a stable point from which the trays can be handled to reduce the risk of inadvertently spilling the primary packages. The inclusion of a handle means is very advantageous, since the weight of beverages packaged in this manner is a significant consideration.

The handle means can be a handle or a device for grasping with a hand. The handle can be either a separate component adjoined to the secondary package or integral to the secondary package. As a separate component, the handle can be adapted from the same material as the secondary package, string, rope, or other conventional means for making a handle. If integral to the secondary package, the handle can be formed from two essentially parallel lines of weakness. Each line of weakness has a first end that begins at a first distance from the center of the medial hinge line and a second end that terminates at a second distance from the center of the medial hinge line. The first and second distances are preferably essentially equal.

The invention includes a method for dispensing a plurality of primary packages from a secondary package for the primary packages. The method includes the step of tearing a zone of weakness on the secondary package. The tearing step is performed by cutting, removing, or otherwise severing the zone of weakness.

In a preferred embodiment, the tearing step is performed by removing the zone of weakness. The secondary package has an opposed pair of panels in spaced relation. A first panel has a medial hinge line, which bifurcates the first panel. The zone of weakness extends from a first end of the medial hinge line around the outer circumference of the secondary package to a second end of the medial hinge line.

The method further includes the step of folding the secondary package in a rotating motion. The folding step bends the medial hinge line, thereby dividing the secondary package into a plurality of dispensing means. The folding step can be performed by applying a lateral, rotational bending moment about the medial hinge line. The bending force folds the first panel against itself to form a mutually adjacent pair of dispensing means.

A preferred embodiment of the invention comprises a step for producing a handle. The step includes tearing and folding a handle means, such that the handle means is positioned between the mutually adjacent pair of dispensing means.

The step of positioning the means for dispensing then occurs. In the positioning step, the dispensing means can be transported to a location suitable for chilling and/or dispensing, such as a refrigerator shelf, table, or counter top. In a preferred embodiment the positioning step is performed using the handle means.

The invention includes a carton blank. The carton blank is especially adapted for use in connection with the secondary package suitable for shipping and dispensing a plurality of primary packages and the method for dispensing described above.

The carton blank includes a first series of flaps, a second series of flaps, and a web. The first and second series of flaps are arranged in opposed relation on either side of a longitudinally extending web. Each series of flaps includes individual flaps that extend laterally from corresponding sections of the web that are defined by interposed hinge lines.

The first and second series of flaps are adapted to be cojoined to form respective first and second walls of a carton. The sections of the web correspond to at least a portion of the third wall, the fourth wall, the first panel, and the second panel.

The longitudinally opposed ends of the web are adapted to be cojoined to produce a tubular form, whereby, with the individual flaps of the first and second series of flaps cojoined to form respective first and second end walls, a carton is formed. The carton has four serially interconnected, rectangular walls in which serial pairs of the walls are cojoined along respective mutually adjacent edges to circumscribe a generally rectangular volume. The walls support a plurality of mutually opposed panels in spaced relation on either side of the circumscribed volume, thereby substantially enclosing the volume.

The blank has a first section of the web that defines the first panel and includes a medial hinge line. The medial hinge line extends from a first edge to a second edge of the first section. Adjoined to the first and second edge of the first section are corresponding individual first and second flaps of the first and second series of flaps. The first and second flaps extend laterally from the respective first and second edges of the first section. The first and second flaps include laterally extending zones of weakness aligned with the medial hinge line arranged on the first section.

A second section of the web defines a second panel. The second panel has a first and a second edge. Adjoined to the first and second edges of the second panel are corresponding individual third and fourth flaps of the first and second series of flaps. The third and fourth flaps extend laterally from the first and second edges of the second section. A zone of weakness extends laterally across the third and fourth flaps and the second section. Each of the zones of weakness on the flaps of the first and second sections is adapted to be aligned in mutual register when the blank is configured in the above-mentioned tubular form.

The carton blank includes a handle means. The handle means is desirably arranged midway along the medial hinge line of the first section and is adapted to extend internally of the enclosed volume. It is especially preferred that the handle means be integrally formed from the blank. The handle means can be defined by lines of weakness that circumscribe free edges of the handle means when the handle means is deployed. In a preferred embodiment, the handle means is defined by spaced, generally parallel lines of weakness. The spaced, generally parallel lines coextend from a first root on the hinge line to a second root on the hinge line such that the handle means forms a valise-type handle. The first and second roots are located opposite one another about the center of the medial hinge line. The handle means can be readily deployed in elevated graspable relation once the carton has been opened into the earlier mentioned dispensing means.

The blank is preferably structured such that the zones of weakness comprise a pair of spaced-apart lines of weakness defining a tear strip between them. The lines are generally parallel. In a preferred embodiment, it is advantageous that the zones of weakness on the first, second, third, and fourth flaps extend in mutually divergent relation as they traverse laterally away from corresponding edges of the first and second sections of the web.

A preferred embodiment of the invention facilitates an advantageous presentation profile at the ends of the dispensing means. The portions of the lines of weakness, which extend over the first, second, third, and fourth flaps that form the first and second walls of the assembled carton, are mutually divergent as they move away from the web. This divergence continues until the lines of weakness reach an exceptionally spaced-apart distance, whereupon the lines of weakness become mutually convergent until the outermost edge of the respective flap is reached. The second section has lines of weakness that extend in the same generally parallel relation described above. Once the tear strip is pulled away from the carton, the two dispensing means have partially cut-away, container-presentation profiles along free edges at corresponding ends of each of the dispensing means formed by tearing the zones of weakness on the individual flaps.

The carton blank can include hand grip means. The hand grip means can be included on at least one of the web sections that correspond to the third and fourth walls. In a preferred embodiment, the hand grip means is adapted to permit the carton to be carried in a suitcase fashion.

FIG. 1 illustrates an elevated perspective view of a secondary package 2, for example, a carton, with a medial hinge line 10 shown on a first panel 8. The carton 2 has four serially interconnected, rectangular walls, a first wall 3 (not shown), a second wall 4, a third wall 5 (not shown), and a fourth wall 6. The first wall 3 (not shown) is opposite the second wall 4. The third wall 5 (not shown) is opposite the fourth wall 6. The first wall 3 (not shown), the second wall 4, the third wall 5 (not shown), and the fourth wall 6 are cojoined along respective mutually adjacent edges 7, to circumscribe a generally rectangular volume. The four walls 3, 4, 5, and 6 support a mutually opposed pair of panels, 8 and 9 (not shown), in spaced relation from one another, thereby substantially enclosing the volume that is occupied by the primary packages (not shown), such as cylindrical containers. The first panel 8 is bifurcated by the medial hinge line 10. A zone of weakness 13 is shown on the second wall 4. A hand grip means 28 is illustrated on the fourth wall 6. The hand grip means 28 permits the carton 2 to be carried in a suitcase fashion.

Figure 2:
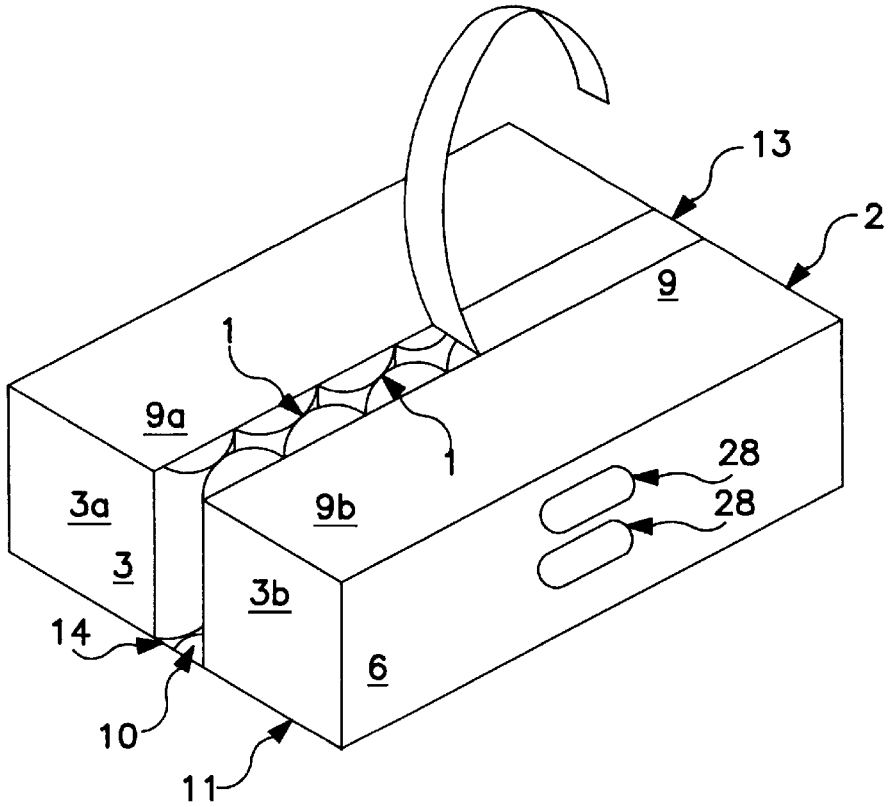
FIG. 2 illustrates an elevated perspective view of the carton shown in FIG. 1 rotated 180° about its latitudinal axis and showing a zone of weakness.

FIG. 2 illustrates an elevated perspective view of the carton 2 rotated 180° about its latitudinal axis, thereby showing a first wall 3 and a second panel 9, each having the zone of weakness 13. The carton 2 is occupied by the primary packages 1 shown in FIG. 2 as cylindrical containers. The zone of weakness 13 has been torn from the first wall 3, dividing it into two portions 3*a* and 3*b*, and partially torn from the second panel 9. The zone of weakness 13 extends from a first end of the medial hinge line 10 around the outer circumference of the carton to a second end of the medial hinge line 10. Specifically, the zone of weakness extends from a first intersection 14 (defined by the intersection of the first end of the medial hinge line and a first edge 11 of the first panel 8 (not shown)), across the first wall 3, across the second panel 9, and across the second wall 4 (not shown) to a second intersection (not shown) defined by the intersection of the second end of the medial hinge line 10 and a second edge (not shown) of the first panel 8 (not shown). A hand grip means 28 is illustrated on the fourth wall 6.

Figure 3:
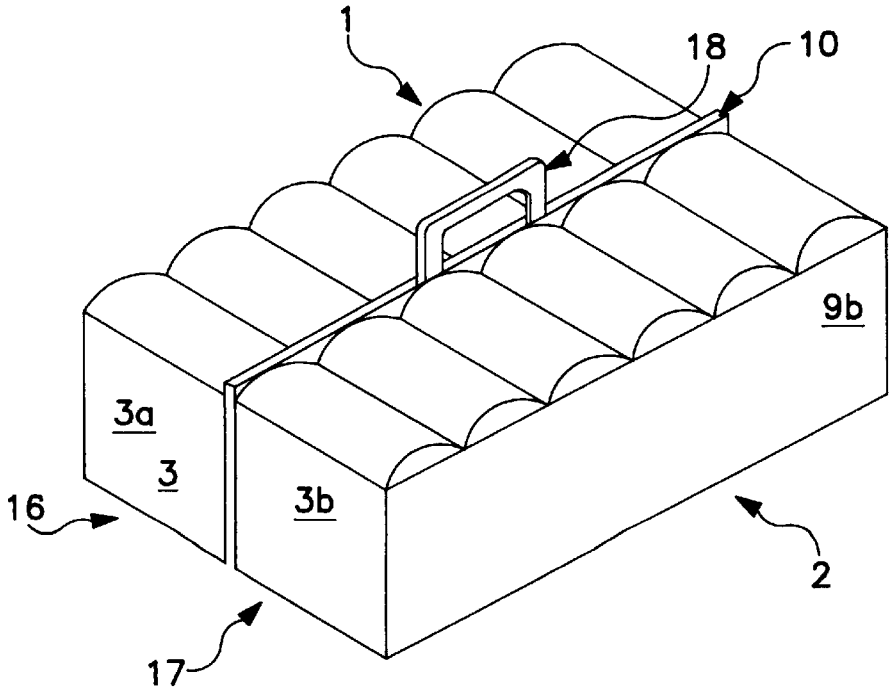
FIG. 3 illustrates an embodiment wherein the zone of weakness has been removed and the carton has been opened about a medial hinge line to produce a plurality of dispensing means.

FIG. 3 illustrates an embodiment of the invention wherein the zone of weakness (not shown) has been removed and the carton 2 has been opened about a medial hinge line 10 to produce a first tray and a second tray 17 respectively. Both the first tray 16 and the second tray 17 contain a plurality of primary packages 1 shown here as cylindrical containers. The handle means 18 is shown elevated between the first tray 16 and the second tray 17 respectively.

Figure 4:
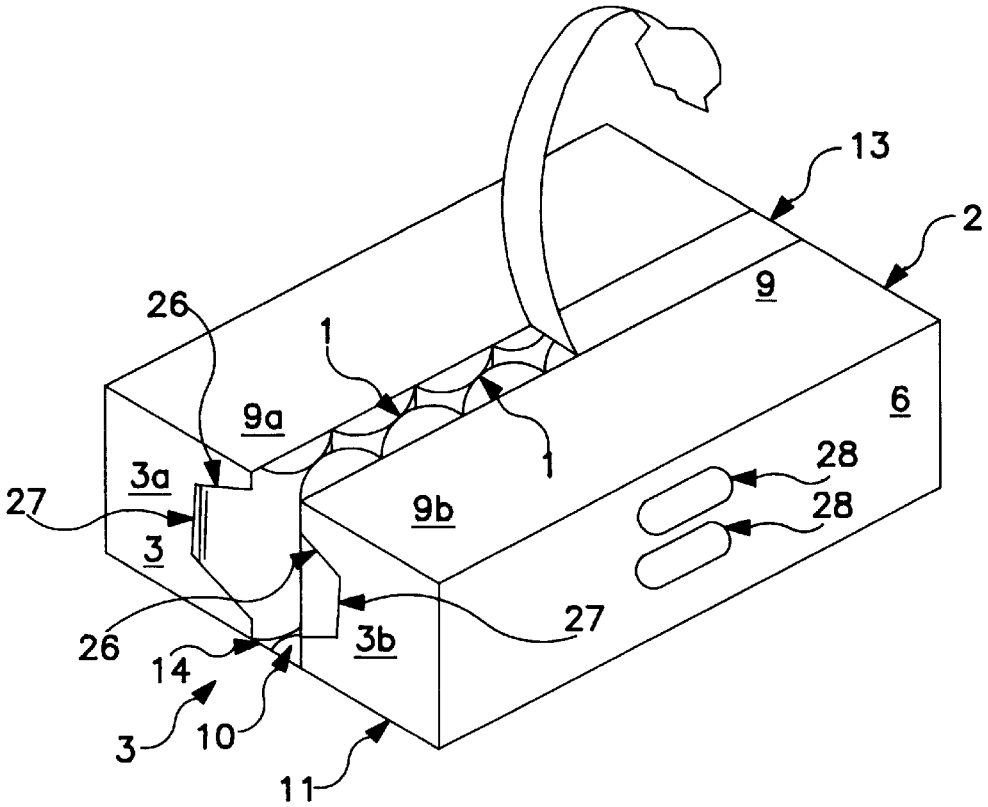
FIG. 4 illustrates an elevated perspective view of a preferred embodiment of the carton with the zone of weakness partially removed.

FIG. 4 illustrates an elevated perspective view of a preferred embodiment of the carton 2 with the zone of weakness 13 partially removed. The zone of weakness 13 extends from a first end of the medial hinge line 10 around the outer circumference of the carton to a second end of the medial hinge line 10. Specifically, the zone of weakness extends from a first intersection 14 defined by the intersection of the first end of the medial hinge line and a first edge 11 of the first panel 8 (not shown), across the first wall 3, across the second panel 9, and across the second wall 4 (not shown) to a second intersection (not shown) defined by the intersection of the second end of the medial hinge line 10 and a second edge (not shown) of the first panel 8 (not shown). The zone of weakness 13 has been torn from the first wall 3 and partially torn from the second panel 9, revealing a container profile 26, which is defined by free edges 27. The free edges 27 are exposed once the zone of weakness 13 is removed. Further, the shape of the free edges 27 is dependent upon the shape of the zone of weakness 13. The carton 2 is occupied by the primary packages 1 shown here as cylindrical containers.

Figure 5:
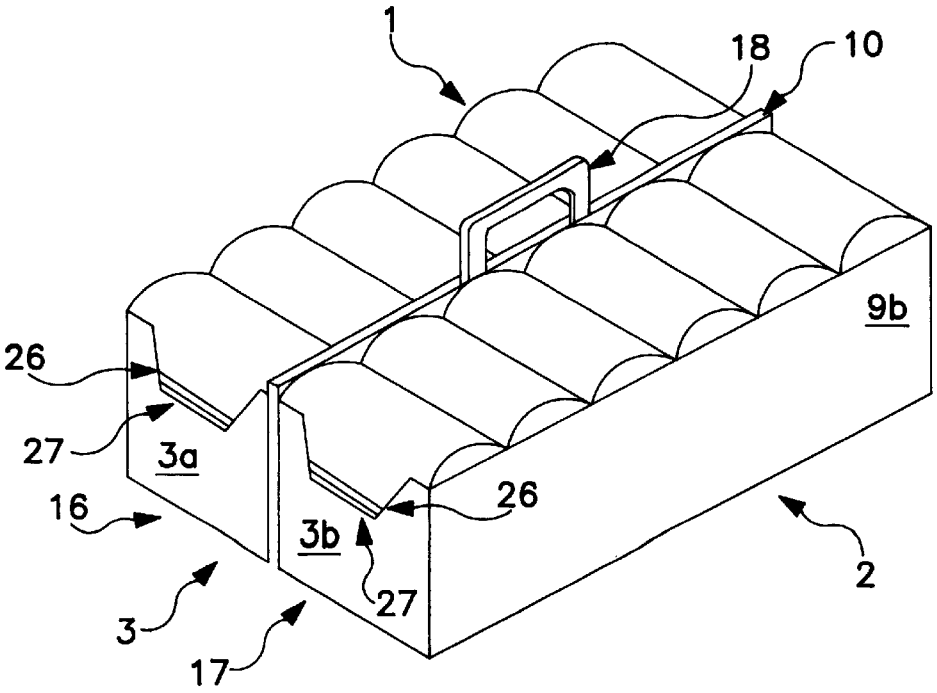
FIG. 5 illustrates a preferred embodiment having a plurality of dispensing means.

FIG. 5 illustrates a preferred embodiment having a first tray 16 and a second tray 17 respectively. Both the first tray 16 and the second tray 17 have two ends, an inner side, an outer side, and a base. The ends of each tray 16 and 17 are defined by respective portions of the first wall 3 and the second wall 4 (not shown). The inner sides of the trays 16 and 17 are defined by the first panel 8 (not shown), which is folded against itself along the medial hinge line 10. The outer sides of the trays 16 and 17 are defined by the respective portions 9*a* and 9*b* of the second panel 9. The bases of the dispensing means are defined by the third and the fourth walls (not shown). Both the first tray 16 and the second tray 17 have a container profile 26, which is defined by free edges 27. The free edges 27 are exposed once the zone of weakness (not shown) is removed. Further, the shape of the free edges 27 is dependent upon the shape of the zone of weakness 13. Both the first tray 16 and the second tray 17 contain a plurality of primary packages 1 shown here as cylindrical containers. Handle means 18 is shown elevated between the first tray 16 and the second tray 17 respectively.

In a preferred embodiment, the carton 2 is operable by selectively tearing along the length of the zone of weakness 13 and thereafter folding on application of a lateral, rotational bending moment about the medial hinge line 10 to form a mutually adjacent pair of dispensing trays 16 and 17. These trays contain spaces that are circumscribed by respective portions 3*a* and 3*b* of the first wall 3, portions 4*a* and 4*b* of the second wall 4, portions 8*a* and 8*b* of the first panel 8, and portions 9*a* and 9*b* of the second panel 9. The third wall 5 and the fourth wall 6, respectively, form bases of the corresponding trays 16 and 17.

Figure 6:
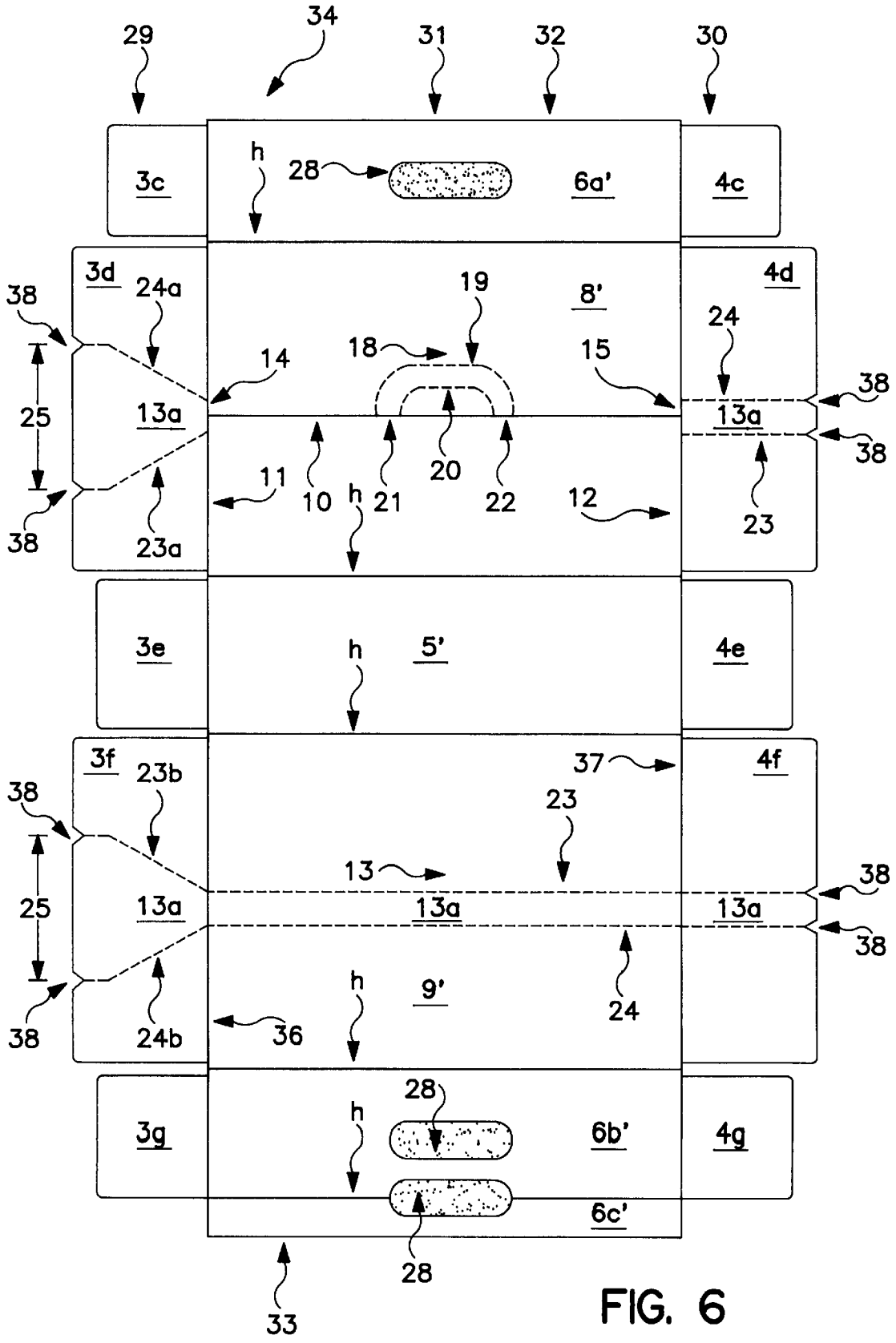
FIG. 6 illustrates a plan view of a unitary carton blank adapted for a preferred embodiment of the invention.

FIG. 6 illustrates a plan view of a unitary carton blank 34 adapted for a preferred embodiment of the present invention. The carton blank includes a first series of flaps 29 and second series of flaps 30 arranged in opposed relation on either side of a longitudinally extending web 31. Individual flaps (3*c*, 3*d*, 3*e*, 3*f*, 3*g*, 4*c*, 4*d*, 4*e*, 4*f*, 4*g*) extend laterally from the corresponding sections of the web 31 that are defined by hinge lines "h."

The first series of flaps 29 and the second series of flaps 30, respectively, are adapted to be cojoined to form the respective first wall 3 and the second wall 4 of the carton 2. A section 6*a'*, a section 8', a section 5', a section 9', a section 6*b'*, and a section 6*c'* of the web 31 correspond to at least one portion of the third wall 5 (not shown), the fourth wall 6 (not shown), the first panel 8 (not shown), and the second panel 9 (not shown).

Longitudinally opposed first end 32 and second end 33 of the web 31 are adapted to be cojoined. A section 6*b'* and a section 6*c'* are secured with a section 6*a'* in partially overlapped relation to produce a tubular form. The associated groups of a first set of flaps 3*c*–3*g* and a second set of flaps 4*c*–4*g* are cojoined to form the first wall 3 and the second wall 4 respectively. Establishing the tubular form and the first wall 3 and the second wall 4 produces the desired carton 2 (not shown).

The section 8' of the blank defines the first panel 8 (not shown) of carton 2. This section includes a medial hinge line 10 extending from a first edge 11 to a second edge 12, thereby bifurcating the first panel 8 (not shown). The flap 3*d* and the flap 4*d* extend laterally from the first edge 11 and the second edge 12 of the section 8', and each flap includes a laterally extending zone of weakness 13*a* aligned in longitudinal register with the medial hinge line 10.

The section 9' of web 31 defines the second panel 9 (not shown). The flap 3*f* and the flap 4*f* extend laterally from the first edge 36 and the second edge 37 of the section 9'. A zone of weakness 13*a* extends laterally across the flap 3*f*, flap 4*f*, and the section 9'. Zones of weakness 13*a* on the first series of flaps 29 (flap 3*d* and flap 3*f*) and on the second series of flaps 30 (flap 4*d* and flap 4*f*) are adapted to be aligned in mutual register in the tubular form.

The carton blank 34 also includes handle means 18 arranged midway along the longitudinal extent of the medial hinge line 10 and adapted to extend internally of the volume substantially enclosed by the assembled carton 2 (not shown). The handle means 18 is preferably integrally formed from the blank and is defined by the first line of weakness 19 and the second line of weakness 20 respectively that circumscribe free edges of the handle means 18 when the handle means 18 is deployed. More particularly, the handle means 18 is defined between the spaced, generally parallel lines of weakness 19 and 20 that coextend from a first root 21 on the medial hinge line 10 to a second root 22 on the hinge line 10. The handle means 18 takes the general form of a valise-type handle.

The zones of weakness 13*a* are defined by a third line of weakness 23 and a fourth line of weakness 24. The third line of weakness 23 and the fourth line of weakness 24 define a tear strip 13*a* between them. The third line of weakness 23 and the fourth line of weakness 24 are generally parallel. In a preferred embodiment of the carton blank 34, the zones of weakness on the flaps 3*d* and 3*f*, defined by portions 23*a*, 24*a*, 23*b*, and 24*b* of the third line of weakness 23 and the fourth line of weakness 24, are not parallel. The portions 23*a*, 24*a*, 23*b*, and 24*b* of the third line of weakness 23 and the fourth line of weakness 24 define the zones of weakness on the flaps 3*d* and 3*f*. The zones of weakness 13*a* on the flaps 3*d* and 3*f* extend in mutually divergent relation from the first edge 11 and the third edge 36 respectively to an exceptionally spaced-apart distance 25 and then in mutually convergent, nonintersecting relation to the edges of the flaps 3*d* and 3*f* opposite the respective first edge 12 and third edge 36, as the lines extend laterally away from the respective section 8' and the section 9'.

The mutually divergent zones of weakness 13*a* on the flaps 3*d* and 3*f* produce an advantageous feature when the zones of weakness 13*a* are removed and the carton 2 (not shown) is folded to display the first tray 16 and the second tray 17 (not shown). This feature results from the portions 23*a* and 24*a* and the portions 23*b* and 24*b* of the lines of weakness 23 and 24 extending over the first wall 3 in mutually divergent relation from the first edge 11 to an exceptionally spaced apart distance 25, and then in mutually convergent, nonintersecting relation to an opposed edge 12. The shape of the zones of weakness 13*a* results in the formation of partially cut-away, container profiles 26 (not shown) along the free edges 27 (not shown) formed at corresponding ends of each of the trays 16 and 17 (not shown), once the zones of weakness 13*a* are pulled away from the carton 2 (not shown). The carton blank 34 has small notches 38, located where the free edges of the flaps 3*d*, 4*d*, 3*f*, and 4*f* meet the lines of weakness 23 and 24, to facilitate a clean start in the tearing process.

The hand grip means 28 is included on at least one of the sections corresponding to the third wall 5 and the fourth wall 6 (not shown) respectively. In a preferred embodiment, a hand grip means 28 is provided in the section 6*a'*, the section 6*b'*, and the section 6*c'* that form the fourth wall 6 (not shown). The hand grip means 28 permits the carton 2 (not shown) to be carried in the preferred suitcase style. The section 6*c'* is adapted to be folded over into a superposed relation on the adjacent section 6*b'*. In the assembled carton 2 (not shown), this arrangement affords a reinforcement for the hand grip means 28.

The carton, according to the invention, is transportable by the consumer from the point of sale, using the hand grips 28, whereby the carton can be conveniently held in a suitcase-style fashion. This structure is especially advantageous in view of the considerable weight of the packaged beverages that are intended to be transported by the carton.

When the consumer desires to place the carton and the containers it holds in a refrigerator, the zone of weakness is torn away from the first wall, the second wall, and the second panel. The small notches, located where the free edges of the flaps meet the lines of weakness, facilitate a clean start to the tearing process. With the zone of weakness removed, the carton is lifted by applying lifting forces to each end of the zone of weakness. This action results in a rotational moment being applied by the weight of the carton's contents about the medial hinge line, which in turn helps to fold the respective halves of the carton outwardly in a manner to expose the first and second trays. By reaching into the tray adapted with the handle means and pressing against the portion of the first panel adjacent to the folded medial hinge line, the handle means can be separated from the first panel. The handle means extends into an elevated graspable position above the primary packages, such as cylindrical containers, which are now oriented on their sides. The trays can then be placed in a refrigerator with minimum difficulty. The containers are thereby easily viewed and accessible within the refrigerator.

The primary and secondary packaging system of the present invention provides the desirable result of providing a carton, such as the secondary package, for commercially handling a plurality of primary packages of individual products. The secondary package can be converted into a plurality of dispensing means, such as trays, for dispensing primary packages containing the products. The zone of weakness provides an added benefit in that its shape is adjustable to produce cutouts in the free edges of the trays. The cutouts aid in dispensing the primary packages of the products from the dispensing means.

What is claimed is:

1. A primary and secondary packaging system for beverage products comprising:

a plurality of primary, axially elongated, uniform, generally cylindrical beverage containers arranged in a planar side-by-side relation in a unitary secondary packaging carton that is adapted for distribution and dispensation of said beverage containers, said carton has:

first, second, third, and fourth serially interconnected, rectangular walls;

serial pairs of said walls being cojoined along respective mutually adjacent edges thereof to circumscribe a generally rectangular volume and support a mutually opposed pair of panels in spaced relation from one another, substantially enclosing said volume that is occupied by a said beverage containers; and each one of said beverage containers is oriented with the axial elongation thereof extending in a direction generally normal to the respective parallel planes defined by said panels;

a predetermined one of said panels having a medial hinge line extending longitudinally from a first edge to a second, opposite, edge of said panel;

a zone of weakness extending longitudinally from a point adjacent to an intersection of said medial hinge line and said first edge, across said first wall, along a second of said panels and across said second wall to a point adjacent to an intersection of said medial hinge line and said second edge;

wherein said carton is operable to tear selectively along a length of said zone of weakness, and thereafter to fold on application of a lateral, rotational bending moment about said longitudinally-extending hinge line to form a mutually adjacent and joined pair of dispensing trays circumscribed by respective portions of said first wall, said second wall, said predetermined one of said panels and said other of said panels, and wherein the third and fourth walls each individually form a base of each of said dispensing trays;

a handle arranged midway along said longitudinally extending hinge line, said handle extends internally of said volume and is arranged to present in elevated graspable position between said trays upon opening of said carton;

and a hand grip on at least one of said third wall and said fourth wall.

2. The system of claim 1 wherein said handle is integrally formed from said carton and is defined by lines of weakness that circumscribe free edges of said handle when said handle is deployed in said elevated graspable position.

3. The system of claim 2 wherein said handle is defined between spaced, generally parallel lines of weakness that co-extend from a first root on said hinge line to a second longitudinally spaced apart root on said hinge line and form a generally valise handle.

4. The system of claim 1 wherein said zone of weakness comprises a pair of spaced apart lines of weakness defining a tear strip therebetween, said lines are generally parallel and separated by a distance marginally greater than a diameter of one of said containers.

5. The system of claim 4 wherein portions of said lines of weakness extend over said first wall in mutually divergent relation from said first edge to an exceptionally spaced apart distance, then in mutually convergent, nonintersecting relation to an opposed edge, and thereafter along said other panel in said generally parallel relation to form partially cut-away, container-presentation profiles along free edges formed at corresponding ends of each of said trays once said tear strip is pulled away from said carton.

6. The system of claim 1 wherein said hand grip is a structure permitting said carton to be carried in suitcase fashion.

7. The system of claim 1 wherein said carton further comprises pleats.

8. A unitary carton blank comprising:

a first and second series of flaps arranged in opposed relation on either side of a longitudinally extending web, said flaps extend laterally and individually from each of a series of sections of said web defined by hinge lines;

said first and second series of flaps are capable of being cojoined to form, respectively, a first wall and a second wall of a carton;

each section of said web corresponds to at least a portion of a third wall and a fourth wall and a first panel and a second panel;

a hand grip on at least one of said sections corresponding to said third wall and said fourth wall;

longitudinally opposed ends of said web are capable of being cojoined to produce a tubular form whereby, when the flaps are cojoined to form, respectively, a first end wall and a second end wall, a carton can be formed having first, second, third, and fourth serially interconnected, rectangular walls with serial pairs of said walls being cojoined along respective mutually adjacent edges to circumscribe a generally rectangular volume and support said first panel and said second panel in mutually opposed spaced relation on either side of said volume and substantially enclose the volume;

a first section includes said first panel and a medial hinge line extending longitudinally from a first laterally spaced edge to a second laterally spaced edge of said section;

a handle arranged midway along said longitudinally extending hinge line and adapted to extend internally of said volume;

corresponding flaps of said first and second series of flaps extend laterally from said first and second edges of said first section and include respective laterally extending zones of weakness aligned in longitudinal register with said medial hinge line;

wherein a second section defines said second panel having corresponding flaps of said first and second series of flaps extending laterally from first and second edges of said second section, and zones of weakness extend laterally across said flaps and said second section; and said zones of weakness on said corresponding flaps of said first and second sections are adapted to be aligned in mutual register when said tubular form is produced.

9. The blank of claim 8 wherein said handle is integrally formed from said blank and is defined by lines of weakness that circumscribe free edges of said handle when said handle is deployed.

10. The blank of claim 9 wherein said handle is defined between spaced, generally parallel lines of weakness that co-extend from a first root on said hinge line to a second longitudinally spaced apart root on said hinge line and form a generally valise handle.

11. The blank of claim 8 wherein said zones of weakness comprise a pair of spaced apart lines of weakness defining a tear strip therebetween, wherein said lines are generally parallel.

12. The blank of claim 11 wherein portions of said lines of weakness extend on said flaps of said first series in mutually divergent relation as said lines extend laterally away from said first and second sections.

13. The blank of claim 8 wherein said hand grip is a structure permitting said carton to be carried in suitcase fashion.

14. A method for dispensing a plurality of primary packages from a unitary secondary packaging carton that is adapted for distribution and dispensation of said beverage containers, said carton has:

first, second, third, and fourth serially interconnected, rectangular walls;

serial pairs of said walls being cojoined along respective mutually adjacent edges thereof to circumscribe a generally rectangular volume and support a mutually opposed pair of panels in spaced relation from one another, substantially enclosing said volume that is occupied by said beverage containers; and each one of said beverage containers is oriented with the axial elongation thereof extending in a direction generally normal to the respective parallel planes defined by said panels;

a predetermined one of said panels having a medial hinge line extending longitudinally from a first edge to a second, opposite, edge of said panel;

a zone of weakness extending longitudinally from a point adjacent to an intersection of said medial hinge line and said first edge, across said first wall, along a second of said panels and across said second wall to a point adjacent to an intersection of said medial hinge line and said second edge;

wherein said carton is operable to tear selectively along a length of said zone of weakness, and thereafter to fold on application of a lateral, rotational bending moment about said longitudinally-extending hinge line to form a mutually adjacent and joined pair of dispensing trays circumscribed by respective portions of said first wall, said second wall, said predetermined one of said panels and said other of said panels, and wherein the third and fourth walls each individually form a base of each of said dispensing trays;

a handle arranged midway along said longitudinally extending hinge line, said handle extends internally of said volume and is arranged to present in elevated graspable position between said trays upon opening of said carton;

and a hand grip on at least one of said third wall and said fourth wall;

said method comprising:

severing the zone of weakness on the secondary packaging carton; and folding the secondary packaging carton in a rotating motion about its medial hinge line thereby dividing said secondary packaging carton into a plurality of mutually adjacent dispensing means.

15. The method of claim 14 further comprising the step of producing a handle by tearing and folding said handle such that said handle is positioned between said mutually adjacent dispensing means.

* * * * *